US006364179B1

(12) United States Patent
Sullivan

(10) Patent No.: US 6,364,179 B1
(45) Date of Patent: Apr. 2, 2002

(54) TELESCOPING VALVE ASSEMBLY AND METHOD FOR USE THEREOF

(75) Inventor: Joseph J. Sullivan, Scituate, MA (US)

(73) Assignee: CDF Corporation, Plymouth, MA (US)

( * ) Notice: Subject to any disclaimer, the term of this patent is extended or adjusted under 35 U.S.C. 154(b) by 0 days.

(21) Appl. No.: 09/545,219

(22) Filed: Apr. 7, 2000

(51) Int. Cl.[7] ..... B65D 35/00
(52) U.S. Cl. ..... 222/538; 222/130
(58) Field of Search ..... 222/105, 130, 222/131, 519, 520, 522, 523, 525, 527–532, 537, 538, 548, 549, 553

(56) References Cited

U.S. PATENT DOCUMENTS 2,083,776 A * 6/1937 Ferguson ..... 222/537
2,738,796 A * 3/1956 Chadwick ..... 222/522
3,039,656 A * 6/1962 Wentz ..... 222/519
4,025,048 A * 5/1977 Tibbitts ..... 222/519
4,169,548 A * 10/1979 Bond ..... 222/538
4,997,108 A * 3/1991 Hata ..... 222/105
5,775,541 A 7/1998 Perkins

* cited by examiner

*Primary Examiner*—J. Casimer Jacyna
(74) *Attorney, Agent, or Firm*—Dorsey & Whitney LLP

(57) ABSTRACT

A telescoping valve assembly that is integrally attached to a container. The valve assembly includes a slide member that is movably attached to a sleeve, the sleeve being attached to a liner or a container. The slide member can be telescoped to a desired protrusion distance from the surface of the container. Once the slide member is in the desired position, a plug is taken off and a valve shaft is turned. The valve shaft controls the opening and closing of a valve assembly inside of the slide member and in this way the precise rate of flow of material from the container can be controlled.

12 Claims, 5 Drawing Sheets

Figure 4
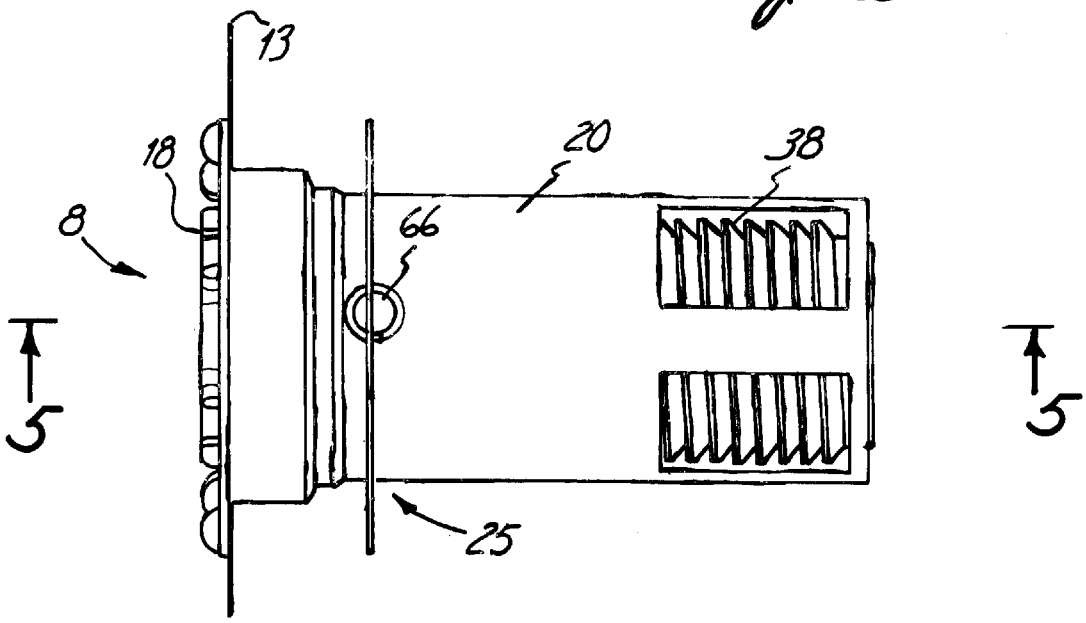
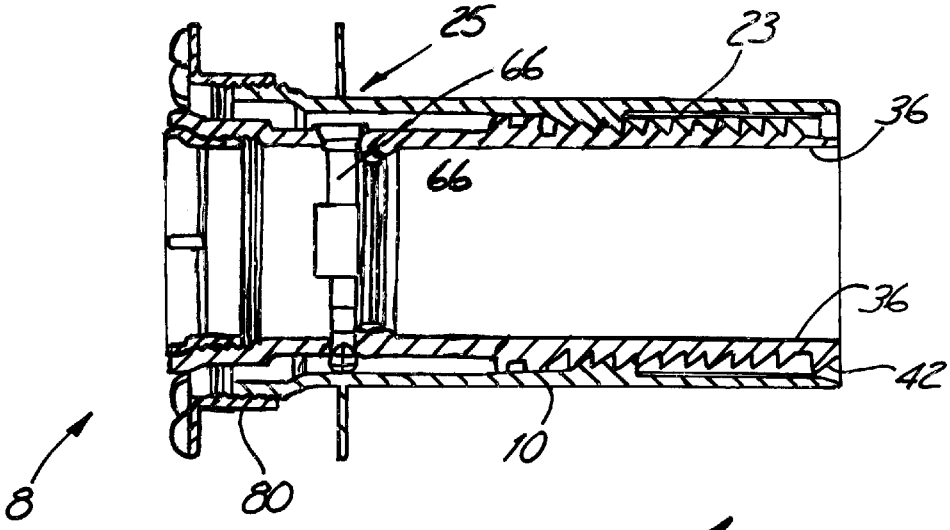
Figure 5

TELESCOPING VALVE ASSEMBLY AND METHOD FOR USE THEREOF

BACKGROUND OF THE INVENTION

1. Field of the Invention

The present invention is directed to a telescoping valve assembly for a container and a method for use thereof, more particularly, a telescoping valve assembly and method of use wherein the valve assembly is integrally affixed to a container.

2. Description of the Prior art

Containers are frequently used to ship, store, dispense, and handle liquids and other free flowing materials such as powders, pellets, etc. Facilitating the removal/dispensation of these materials from the container used for storage and shipment is desirable. Simply providing an opening for the removal of the material without means to control the dispensation rate is undesirable because flow rates of the material from the containers cannot be adjusted as material is needed. Including a valve assembly along with a spout enables rate controlled dispensation of the material.

The valve and spout assembly of the present invention is particularly desirable for use with an intermediate bulk container, such as those disclosed in co-pending U.S. application Ser. No. 09,499,128, filed Feb. 7, 2000, which is herein incorporated by reference. The container contains a primary container in the form of an inner liner which actually contains the material. A rigid box-like structure forms the secondary container and houses the flexible and/or non-flexible liner. The valve and spout assembly is affixed to the liner of the rigid box-like support structure. These containers are often referred to by the name intermediate bulk containers ("IBC"). The valve and spout assembly is located in an area where it is accessible via a port in one of the panels for dispensation of the material. The IBC secondary containers come in many different sizes and may be made out of wood, plastic, steel, cardboard, or other types of materials with wall thicknesses of varying sizes. The primary container liners are often made out of a flexible plastic material, high density polyethylene, or other materials well known in the art.

Prior art containers include valve and spout assemblies that are removably attached to the liner of the container. These types of valves and spouts are undesirable because of the need to keep track of separate parts. Shipping of the valve and spout assembly parts is often done separately from the material, resulting in extra shipping costs, lost valves, incorrect fittings, broken pieces, and wasted time and effort. The prior valve and spout assemblies also require the extra effort of attaching the spout to the container before the removal of the material. Since container walls are not of uniform width, ensuring the correct valve length to ameliorate the dispensation of the material from the container is a constant difficulty. In addition, special tools needed for the attachment and removal of these assemblies creates a further hindrance.

U.S. Pat. No. 5,775,541 to Perkins ("Perkins") teaches a valve and spout assembly that is permanently attached to the liner. One problem with Perkins, however, is that the valve has no means contained therein to control the dispensation rate. The Perkins valve has a slide that must be pushed in toward the container to break a seal and initiate the flow of material. The slide breaks the seal and starts the flow, however, the assembly is simply an on/off flow control apparatus. Furthermore, the Perkins valve assembly does not allow for the precise control of the length in which the valve protrudes from the container. The valve cannot be extended to provide easier access depending on the wall thickness of the container used. In fact, the Perkins valve is stored and shipped in a substantially out position. The out position of the Perkins subjects it to snagging, storage, and handling difficulties.

A need exists for a valve and spout assembly that can be integrally affixed to the surface of a container. This valve and spout assembly should facilitate access to the assembly by the user and be usable with different containers. The present invention valve may be flush or substantially coextensive with the surface of the container liner or the secondary housing container in which the liner is covered, enabling the container to have easy storage and handling properties. In alternative embodiments, the valve assembly may protrude from the liner of the container, but still remain substantially inside of the secondary container of the IBC. In still a further embodiment, the valve assembly may be attached to a liner with one end substantially flush with the outer secondary container. As will be appreciated by one skilled in the art, various combinations of the protrusion distance from the liner or the container may be implemented without changing the fundamental nature of the present invention.

SUMMARY OF THE INVENTION

The present invention provides an improved valve and spout assembly that can be integrally affixed to a container. The valve and spout assembly is easily operated using conventional tools and attachments. Furthermore, the valve and spout assembly includes a slidable member to allow for the precise adjustment of the protrusion distance from the container. Finally, the present invention includes a valve member attached to the spout that allows for the control of the dispensation rate of the material contained therein.

One embodiment of the present invention comprises a sleeve operably connected with a container, the sleeve further comprising an inner surface. The valve assembly further comprises a slide member movably attached to the inner surface of the sleeve and a valve member operably connected to the slide member.

A combination container and telescoping valve assembly whereby the controlled rate of removal of a material from the container is achieved, the combination comprising a container and a telescoping valve assembly operably attached to the container. The combination container and telescoping valve assembly may further include a sleeve, a slide member, and a valve member. The slide member may be operably attachable and selectively positionable to the sleeve, and the valve member operably attachable to the slide member.

A method for removing the contents of a container comprising providing a telescoping valve assembly of the type having a slide member, a sleeve, and a valve member, the slide member selectably positionable relative to the sleeve between a retracted position and an extended position. The method may further comprise extending the slide member to a desired extended position, opening the valve member to obtain a desired amount of the material of the container, and closing the valve member.

An object of the present invention is to provide an apparatus for the easy removal of materials from a container.

Another object of this invention is to provide an apparatus affixed to a container for the removal of materials from the container.

Yet another object of this invention is to provide an apparatus for the removal of materials from a container that is attached to the container and allows for the easy control of the dispensation rate of the contained material.

Another object of this invention is an apparatus for dispensation of material from a container that provides a means to control the distance the valve protrudes from the container.

A further object of this invention is to provide an apparatus for the removal of materials from a container that is incorporated in the container in such a way that one end of the apparatus is substantially coextensive to the surface of the container.

Another object of the present invention is a valve and spout assembly that can be operated using standard tools.

A further object of the present invention is a method for removal of material from a container using a valve assembly in which the flow of material can be controlled and the protrusion distance of the valve assembly from the container can also be controlled.

Yet another object of this invention is to provide a combination container and telescoping valve assembly whereby the controlled rate of material from the container is achieved.

BRIEF DESCRIPTION OF THE DRAWINGS

FIG. 4 is an elevational top view of the telescoping valve assembly in the retracted position.

FIG. 5 is a sectional view of the telescoping valve assembly as viewed along the section line 5—5 of FIG. 4 in the retracted position with the butterfly valve is in the closed position.

DESCRIPTION OF EMBODIMENT

Features and advantages of the device and method of the present invention will become more fully apparent and understood in light of the above-referenced drawings, this description, and the appended claims. Features and advantages will also become apparent in light of the described embodiments of the apparatus and the description of the method or process of making and/or using the telescoping valve assembly of the present invention.

The present embodiment is described in terms of dispensing liquid but the present invention contemplates dispensing any type of free flowing material that is compatible with the present invention. The present embodiment is described in terms of attachment and use with the liner of a substantially rigid box-like IBC. Alternatively, other types of containers, with and without liners, are contemplated for use with the present invention. The embodiment described herein is approximately six inches long in its fully extended state, and about four inches long in its fully retracted state, though valve and spout assemblies of different lengths are contemplated.

The present embodiment further contemplates that the assembly will be substantially flush with the surface of the secondary box-like container and that the sleeve will be attached to the liner. This description does not exclude alternative embodiments that might have the valve and spout substantially coextensive with the liner, or embodiments for use with a container that does not have a liner. All of the components of the present embodiment, unless otherwise specified, may be made of low and/or high density polyethylene, glass filled nylon, or stainless steel.

Any references to front and back, right and left, top and bottom, and upper and lower are intended for convenience of description, not to limit the present invention or its components to any one positional or spatial orientation. As used herein, the terms "valve," "valve assembly," "telescoping valve assembly," or "valve and spout" are intended to include and/or encompass a structure, device, or apparatus used to dispense materials from storage and/or shipment containers and the like.

Figure 1:
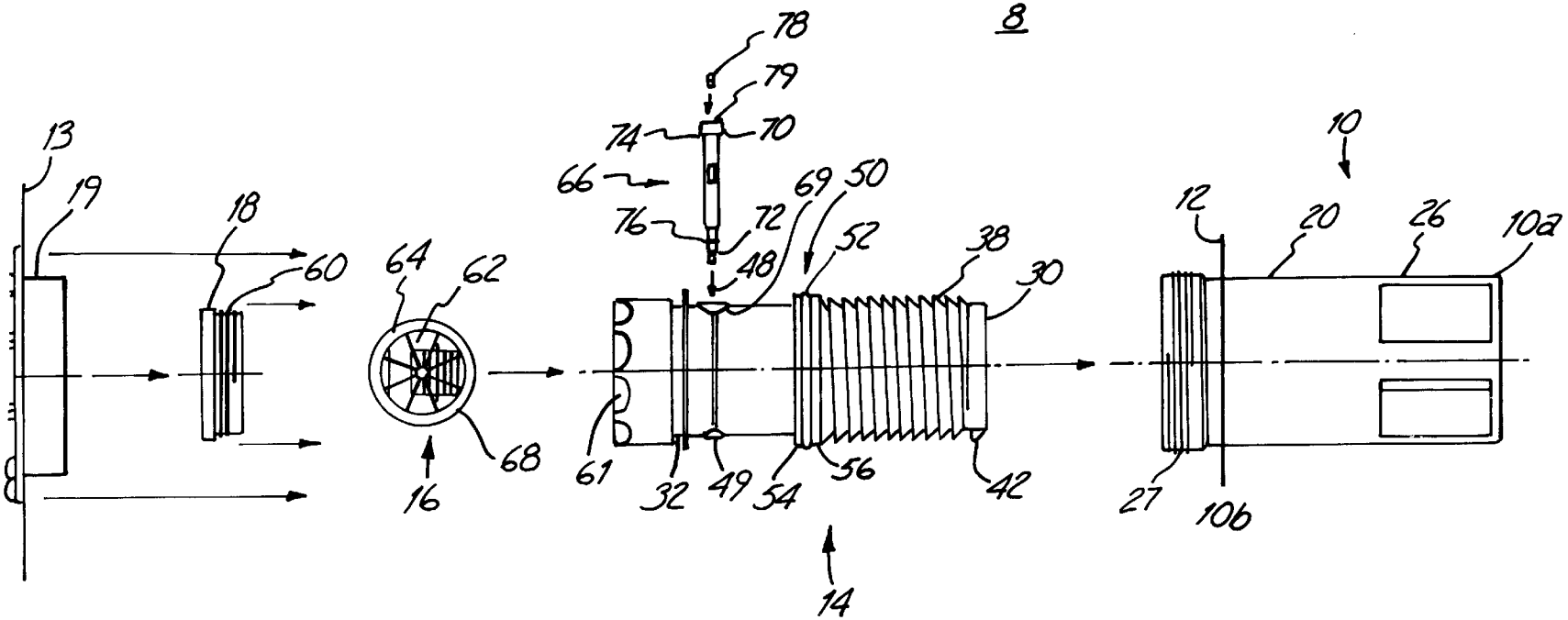
FIG. 1 shows an exploded side plan cut-away view of one telescoping valve assembly embodiment.

FIG. 1 is an exploded view of one valve assembly embodiment 8 of the present invention. The valve assembly 8 includes a sleeve 10 that is integrally connected with a liner 12. The valve assembly 8 of the present embodiment further comprises a slide member 14 and a valve member 16. As shown in the above referenced Figure, the slide member 14 is movably attached to the sleeve 10. In one embodiment, a plug 18 is removably attached to a first end 32 of the slide member 14, and the butterfly valve 16 is operably attached to the slide member 14. An alternative embodiment may have the plug 18 attached to the sleeve 10 instead. In a still further embodiment, a collar 19 may be operably attached to the sleeve 10 and substantially coextensive with a secondary container 13.

Figure 2:
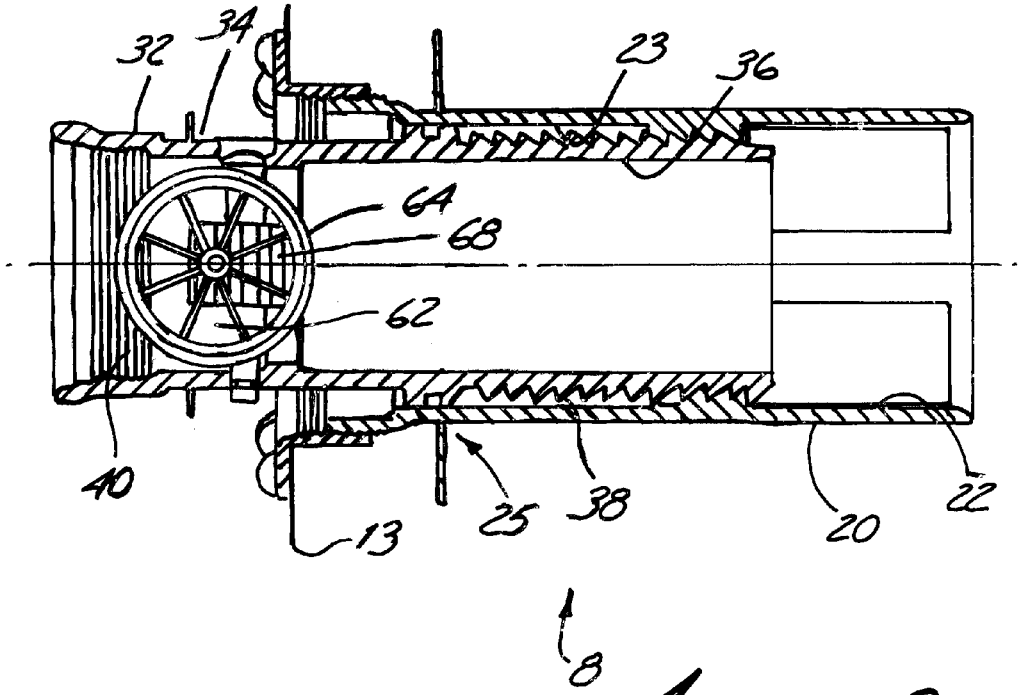
FIG. 2 is a sectional view showing the telescoping valve assembly in the extended position.

With reference to FIGS. 1 and 2, the sleeve 10 of the present embodiment will be described. The present embodiment sleeve 10 may be a substantially cylindrical shape and may be further comprised of a first end 10*a*, a second end 10*b*, an external surface 20, and an internal surface 22. The first end 10*a*, the second end 10*b*, and the internal surface 22 of the sleeve 10 form a substantially hollow chamber therein. The sleeve 10 of another embodiment further comprises a slide surface 23, an internal screw thread form 24, and a liner attachment area 25. The slide surface 23 is formed on the internal surface 22 of the sleeve 10. The internal screw thread form 24 is integrally formed on the internal surface 22. The liner attachment area 25 is located on the external surface 20. In a further embodiment the sleeve 10 further comprises a lattice frame 26 and an external screw thread form 27. The lattice frame 26 is the structure that comprises first end 10*a* of the sleeve 10. This lattice frame 26 may be formed as an extension of the solid shape of the second end 10*b*. The external screw thread form 27 may be operably positioned on the second end of the sleeve 10*b*. The external screw thread form 27 cooperatively interacts with the collar 19 to removably and movably position the collar 19 on the second end 10*b* of the sleeve 10. In different embodiments, the present invention sleeve 10 could take on different shapes and the arrangement of the parts could be in different positions, for example, the internal screw thread form 24 could be closer to the first end 10*a* or the second end 10*b*. Alternatively, the internal screw thread form 24 could be longer. A further embodiment might not have a lattice frame 26 and instead have a shorter sleeve 10. One embodiment may employ a sleeve 10 with a generally square external surface 20 and a generally circular internal surface 22. As will be appreciated by those ordinarily skilled in the art, as long as the shapes are compatible with the herein described elements, including the slide member 14 and the butterfly valve 16, any sleeve shape could be utilized.

As shown in FIG. 1, the external surface 20 of the sleeve 10 has a liner attachment area 25 for fixing the sleeve 10 to the liner 12. This liner attachment area 25 runs contiguously around the entire surface of a diameter of the external surface 20 of the sleeve. In this embodiment the liner 12 is made of substantially flexible material. In another embodiment the material of the liner 12 may be heat sealed to the outer surface of the sleeve. In alternative embodiments, the attachment of the sleeve and liner may be accomplished by any other means known to those ordinarily skilled in the art and compatible with the material of the liner, for example, adhesive bonding. In further embodiments, the junction between the outer surface 20 of the sleeve 10 and the material of the liner 12 may be further coated with several materials known by those ordinarily skilled in the art to ensure that the joint does not leak. The sleeve 10 of the present embodiment is attached to a portion of the liner 12 that provides for the easy dispensing of the contained material. The sleeve 10 might be attached to a different position relative to the liner 12 depending on the desired configuration of the user.

Figure 3:
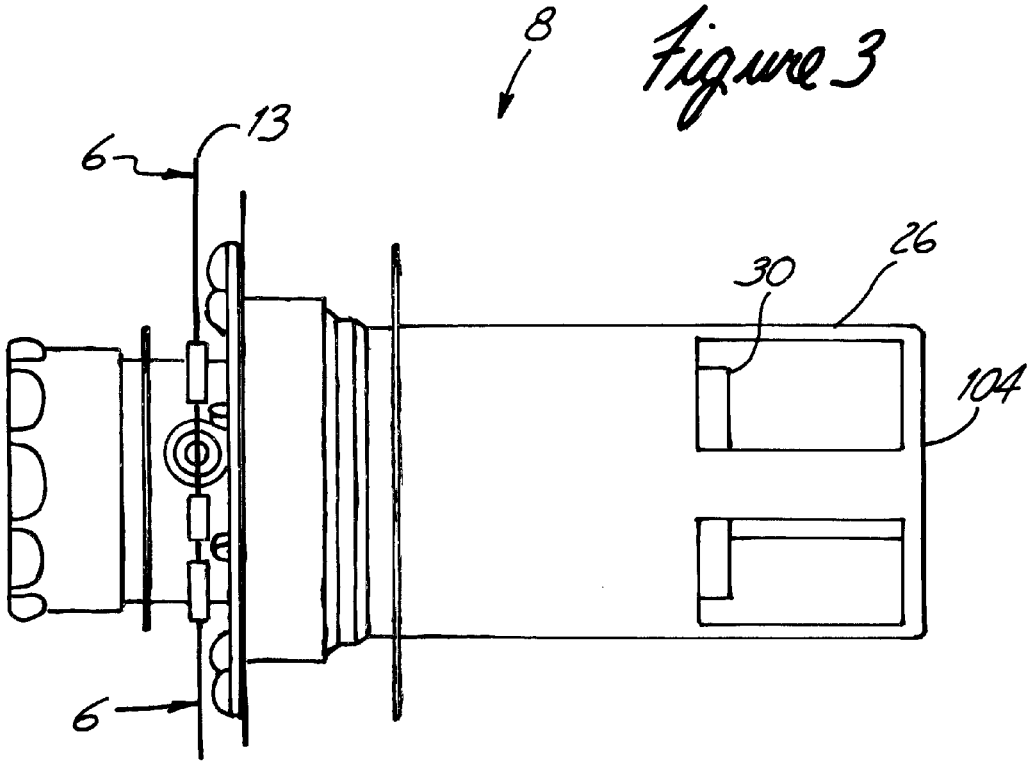
FIG. 3 is an elevational top view of the telescoping valve assembly in the extended position.

As shown in FIGS. 3 and 4, the first end 10*a* of the present embodiment is comprised of a lattice frame 26. This lattice frame 26 allows for the material contained in the liner 12 to more easily flow through the sleeve first end 10*a* and then through the slide member 14. FIG. 3 shows a view of the valve assembly 8 with the slide member 14 in the extended position. As can be seen, the first end 30 of the slide member is substantially planar with the joining between the sleeve first end 10*a* and the second end 10*b* of the sleeve. FIG. 4 shows a view where the slide member 14 of the valve assembly 8 is in the retracted position. A screw thread form 38 of the slide member 14 can be seen through the lattice frame 26 of the sleeve first end 10*a*. In alternative embodiments, the first end 30 of the slide member 14 might be in different positions when the slide member 14 is in the extended position; for example, the slide member 14 might not be protruding from the first end of the sleeve 10*a*, or the slide member 14 might be totally encapsulated within the second end 10*b* of the sleeve.

Referring to FIGS. 1, 2, and 5, the slide member 14 of the present invention will be described. As illustrated in FIGS. 1 and 2, the slide member 14 of the present embodiment has a substantially cylindrical shape and is dispensed inside the sleeve 10. The slide member 14 of the present embodiment is comprised of a first end 30, a second end 32, an outside surface 34, an inside surface 36, a first screw thread form 38, and a second screw thread form 40. In another embodiment, the slide member 14 may be further comprised of a plug 18. The inside surface 36 of the slide member 14 defines a generally hollow chamber. The valve member 16 may be operably connected to the inside surface 36 of the slide member 14. The first screw thread form 38 may be formed on the outside surface 34 of the first end 30 of the slide member 14. The second screw thread form 40 may be formed on the inside surface 34 of the second end 32. The present embodiment plug 18 is removably and movably attached to the second end 32 of the slide member 14. An alternative embodiment may be further comprised of a stop 42, a first opening 44, a second opening 46, a groove 50, and an O-ring 52. The stop 42 of the present embodiment may be located on the first end 30 of the slide member 14, substantially next to the screw thread form 38. The first opening 44 may be on the first end 30 of the slide member 14 and the second opening 46 may be on the second end 32 of the slide member 14. The groove 50 may be substantially aligned at a distance between the first screw thread form 38 and the second screw thread form 40. In another embodiment, the O-ring 52 may be removably nested in the groove 50. In alternative embodiments the groove 50 and O-ring 52 may be generally aligned between the first screw thread form 38 and the first end 30 of the slide member 14. An alternative embodiment may replace the second screw thread form 40 with an alternative plug 18 connection means, such as a bayonet style fitting. A further embodiment of the slide member 14 may further comprise a grip surface 61. The grip surface 61 may be operably attached on the second end 32 exterior surface of the slide member 14. The grip surface of the present embodiment may allow the user to obtain a better grip on the slide member 14 when the user is telescoping the slide member 14 in or out. The grip surface 61 can be comprised of any material and surface shape known to those reasonably skilled in the art.

In the present embodiment, the external surface 20 of the slide member 14 has two generally circular holes 48 and 49 formed in the slide member 14. The circular holes 48 and 49 may be aligned in the slide member 14 surface so that a direct line may be formed through the holes 48 and 49 on both sides of the slide member 14. These holes, 48 and 49, are used to receive the valve shaft 66 which will be discussed in further detail herein.

As shown in FIG. 2 in the present embodiment, the external screw thread form 38 of the slide member 14 may be of such a diameter that it cooperatively interacts with the screw thread form 24 of the sleeve 10. The slide member 14 is movably and rotatably positioned inside the sleeve 10. When the slide member 14 is rotated around the longitudinal axis, the cooperative interaction of the sleeve 10, the screw thread form 24, and the slide member 14 first screw thread form 38 effectuates the movement of the slide member 14 towards either the first end 10*a* or the second end 10*b* of the sleeve 10. The stop 42 ensures that the slide member 14 cannot be totally removed from the sleeve 10.

When the screw thread form 38 extends the slide member 14 to the point where it is in the extended position, the stop 42 will not cooperate with the screw thread form 24 of the sleeve 10, preventing further movement of the slide member 14. If the slide member 14 did not have the stop 42, then the slide member 14 could be removed from the sleeve 10. Removing the sleeve 10 would break the seal and allow the material to escape the liner 12. Another embodiment may include alternative methods to movably attach the slide member 14 with the sleeve 10 known to those reasonably skilled in the art. One alternative embodiment may use a slide member 14 with an O-ring that slidably engages the inner surface 22 of the sleeve 10 and creates enough friction that the slide member 14 could be selectively positioned relative to the sleeve 10 and held into position by the O-ring alone. In still further embodiments, the screw thread form 24 may be of a longer length and thread form 38 be of a shorter length. The slide surface 23 may be interposed on the surface of the slide member 14 and the groove 50 and O-ring 52 might be attached to the internal surface 22 of the sleeve 10.

The telescoping nature of the slide member 14 of the valve assembly 8 is an advantage to the present invention because it allows the distance that the valve assembly 8 protrudes from the liner 12 to be precisely controlled. As mentioned above, this is particularly helpful when the liner 12 is contained inside a secondary container 13 and the valve assembly 8 is accessed via a port in a side of the secondary container 13. Depending on the wall thickness of the secondary container 13, the valve assembly 8 can be expanded a greater or lesser distance from the liner to enable easier access to the slide member 14 and the butterfly valve 16 further described below.

As shown in FIGS. 1 and 2, the present embodiment groove 50 may be located at a distance between the first end 30 and the second end 32 on the external surface 34 of the slide member 14. The present embodiment places the groove 50 substantially aligned with the screw thread 38 just toward the second end 32. As will be appreciated by those reasonably skilled in the art, an alternative embodiment might place the groove 50 in other locations on the outside surface 22 of the slide member 14 as long as the O-ring 52 is positioned to operably interact with the slide surface 23 as described below. With reference to FIG. 2, the groove 50 of the present embodiment may be further comprised of two substantially parallel raised edges 54 and 56. The groove 50 and O-ring 52 are of such a width that the O-ring 52 may be removably nested in between the raised edges 54 and 56 of the groove 50. The O-ring 52 of the present embodiment is shaped so that when it is in place it movably contacts the slide surface 23 of the sleeve 10. The O-ring 52 and the slide surface 23 may be movably nested with each other to facilitate the sealed and movable engagement of the slide member 14 relative to the sleeve 10, creating a fluid and particle tight seal. The seal of the present embodiment does not allow the material in the liner 12 to pass along the exterior surface 34 of the slide member 14 and interior surface 22 of the sleeve 10 and out of the liner 12, bypassing the butterfly valve 16 of the present invention. The present embodiment O-ring 52 may be made of rubber, but alternatively can be constructed of any material known to those skilled in the art. This material should be corrosion resistant and compatible with the material stored in the liner 12. The operation, construction, and usefulness of O-rings are well known in the art and could be modified or replaced by those skilled in the art with another sealing arrangement.

In reference to FIGS. 1 and 2, the valve member 16 of the present invention will be described. The present embodiment valve member 16 is a butterfly valve 16. The butterfly valve 16 may be comprised of a flapper 62, an O-ring 64, a valve shaft 66, and a shaft connector 68. The flapper 62 may be operably attached to the shaft connector 68, which in turn may be removably and operably connected to the valve shaft 66. The present embodiment valve shaft 66 may be removably and rotatably attached to the slide member 14. The O-ring 64 is operably and removably disposed substantially along the edge of the flapper 62. The butterfly valve 16 is used in this embodiment of the present invention as the valve member, but other types of valve members used for controlling the dispensing of materials could be likewise incorporated, including but not limited to ball valves, diaphragm valves, etc.

The present embodiment butterfly valve 16 may be further comprised of a lock 69. The lock 69 of the present embodiment is a half-moon shaped member slidably and operably attached between the butterfly valve 16 and the slide member 14 of the present invention. The lock 69 prevents the rotation of the valve shaft 66 when engaged so that the valve shaft 66 will not be accidently opened. The lock 69 prevents the release material from the liner 12 at an inopportune time. Slidable locks of this type are well known to those reasonably skilled in the art and may be replaced with other devices known to the same.

Figure 7:
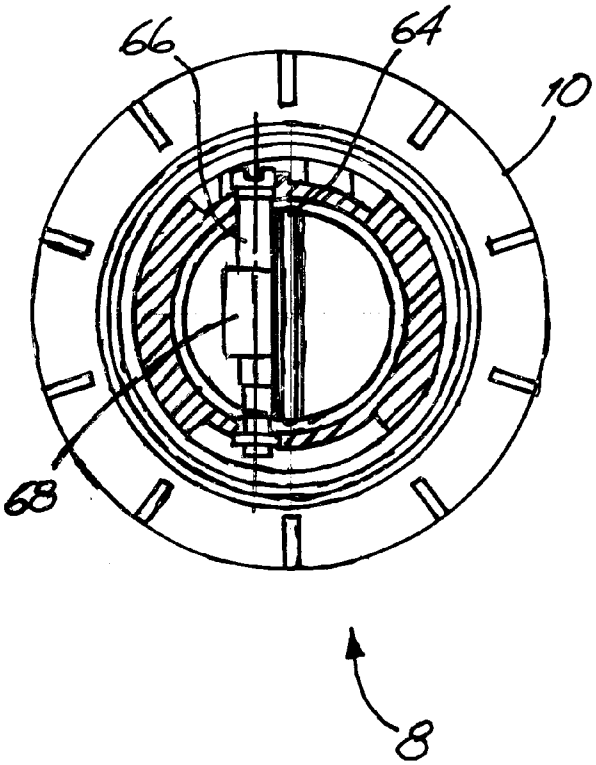
FIG. 7 is a sectional view of the telescoping valve assembly as viewed along the section line 7—7 of FIG. 4 showing the valve member in the open position.

The shape of the flapper 62 of varying embodiments of the present invention will be dictated by the shape of the interior of the slide member 14. The flapper should be of a size and shape to sealably engage the inner walls 38 of the slide member 14, thus restricting the flow of material past the flapper 62. In the present embodiment, the inner surface 38 of the slide member 14 is substantially circular, and so the flapper 62 is also substantially circular. The flapper 68 is shown in FIGS. 1, 2, and 7 in cut-away form. The flapper 62 is a solid member the size and shape of the circular area that is defined by the O-ring 64. The O-ring 64 protrudes a small distance from the surface of the flapper 62 to create the below discussed seal. An alternative embodiment might employ just the flapper 62 without the O-ring 64. In still further embodiments, the flapper 62 might be made of rubber or some other material known in the art so as to not require the O-ring 64 to form the seal with the inner wall 36 of the slide member 14. In still further embodiments the flapper 62, valve shaft 66, and shaft connector 68, might be all formed of one molded removable or non-removable piece.

With reference to FIGS. 1 and 2, the valve shaft 66 will be described. As illustrated, the present embodiment valve shaft 66 is removably and rotatably attached to the slide member 14. The valve shaft of the present embodiment may be made of glass filled nylon, stainless steel, or any other material known to those reasonably skilled in the art with the necessary wear resistance. The valve shaft 66 of the present embodiment may be further comprised of an upper O-ring 70, a lower O-ring 72, a first end 74, and a second end 76, an insert 78, and a cavity 79. The valve shaft 66 of the present embodiment is operably connected to the shaft connector 68. The valve shaft 66 of the present embodiment is used to turn the flapper 62, and thus control the flow of material.

The Upper O-ring 70 of the present embodiment may be placed substantially on the first end 74 of the valve shaft 66. The lower O-ring 72 may be placed substantially on the second end 76 of the present embodiment valve shaft 66. The cavity 79 may be a shape formed into the first end 74 of the valve shaft 66. The insert 78 may be removably placed on the inside of the cavity 79.

Figure 6:
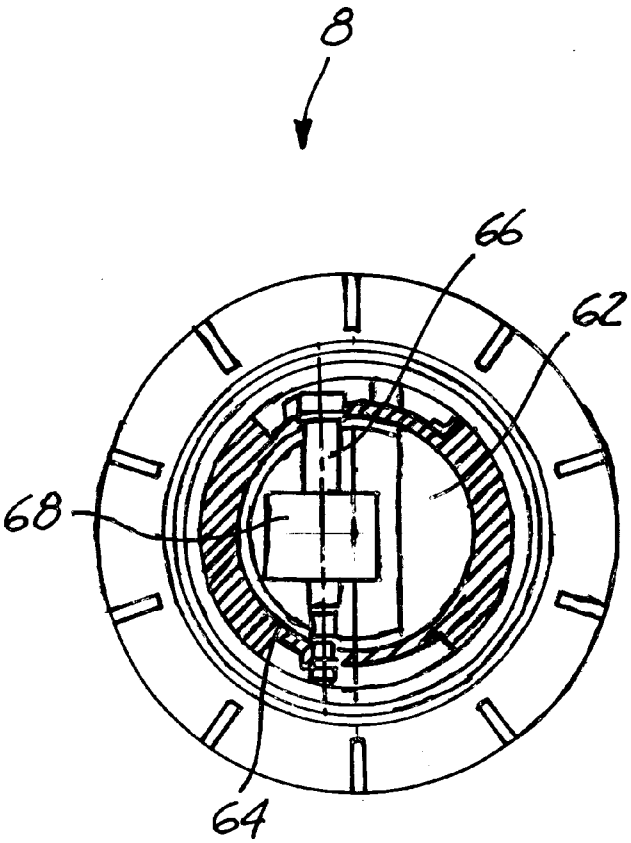
FIG. 6 is a sectional view of the telescoping valve assembly as viewed along the section line 6—6 of FIG. 3 showing the valve member in the closed position.

As shown in FIGS. 3, 6, and 7, the valve shaft 66 of the present embodiment is positioned slightly off-center of the middle of the slide member 14. The valve shaft 66 of the present embodiment is placed slightly off-center so that flapper 62 can be in substantially the center of the slide member 14. As illustrated, the valve shaft 66 does not go through any portion of the flapper 62, instead it is connected by means of the shaft connector 68 described above. Because of this connection to the flapper 62 through the shaft connector 68, the flapper 62 may be substantially in the center portion of the slide member 14. As illustrated in FIG. 6, when the valve shaft 66 of the present embodiment is turned to the full open position, the flapper 62 bisects the slide member 14 along the line 8—8. In alternative embodiments, the valve shaft 66 may be connected to the flapper 62 in other ways, for example, as one molded piece, and so the valve shaft 66 may be placed substantially in the center of the slide member 14.

The upper O-ring 70 may be of such a diameter and elasticity that the inner diameter of the O-ring 70 is just larger than the outer diameter of the first end 74 of the valve shaft 66. In this way, when the upper O-ring 70 is placed around the first end 74 of the valve shaft 66, the O-ring 70 sealably and removably engages the valve shaft 66. The upper O-ring of the present embodiment 70 operably interacts with the slide member 14 to create a seal by which no stored material can escape through the hole 44 when the valve 16 is in use. The lower O-ring 72 may be removably attached in the same manner. The upper O-ring 70 and lower O-ring 72 seals further enable the valve shaft 66 to be rotated relative to the slide member 14 without the seals being broken. In alternative embodiments, other methods of operably and removably attaching the upper O-ring 70 and the lower O-ring 72 to the valve shaft 66 first end 74 and second end 76, respectively, could likewise be incorporated. The O-rings 70 and 72 could also be replaced by other means know in the art to create the proper seal.

One embodiment valve shaft 66 may be further comprised of an insert 78 and a cavity 79. The cavity 79 may be formed generally on the first end 74. The insert 78 may be removably mated to the cavity 79. The cavity 79 of the present embodiment is shaped to receive a standard Allen wrench tool. Alternative embodiments for the shape of the cavity could include shapes designed to operably receive tools such as a standard or Phillips screw head, a hex head, or the like. Still further embodiments might instead have a knob attached to the valve shaft 66 first end 74 which can be grasped by hand. Any means known to those skilled in the art to effectuate the rotation of the valve shaft 66, and so the valve member 16 as a whole, may be employed.

As shown in FIG. 1, the valve shaft 66 may be further comprised of an insert 78. The insert 78 of the present embodiment fits inside the first end 74 of the valve shaft 66, more specifically, inside the cavity 79. When the valve shaft 66 is inserted in the slide member 14 and engages the shaft connector 68, the cavity 79 is accessible. By removal of the insert 78, the valve shaft 66 may be turned by means of the cavity 79 using a standard Allen wrench.

The insert 78 of the present embodiment fits the cavity 79. The insert 78 of the present embodiment may further engage the lock 69. In one embodiment, the insert 78 may fit into the cavity 79 and operably engage the lock 69 in such a manner that valve shaft 66 may not be moved while the insert 78 is present. In alternative embodiments the lock 69 may be replaced with other designs known to those skilled in the art.

Referring now to FIGS. 1, 2, and 3, the plug 18 of the present embodiment will be described. The plug 18 of the present invention may be further comprised of an external screw thread 60. The external screw thread 60 may have an outer diameter such that it can cooperatively interact with the screw thread form 40 of the second end of the slide member 14. The plug 18 is desirable because it protects the valve assembly 8 from damage and because it provides an additional sealing means during transportation and storage. The plug 18 of the present embodiment is made of the same low and high density polyethylene material as the sleeve 10 and the slide member 14, however the plug 18 could be made of any material known in the art. The plug 18 of the present invention may be further comprised of any means known to those reasonably skilled in the art to facilitate inserting and removing it. Though the plug 18 of the present embodiment is attached by means of a screw thread interaction, other methods known to those skilled in the art to be effective for this type of attachment can be utilized, such as "push and twist" connections commonly used in child-proof containers, or alternatively a bayonet connection. In alternative embodiments the plug 18 could be replaced with a screw cap, or some other end protection device known to those reasonably skilled in the art.

With reference to FIGS. 1, 2, and 3 the collar 19 will be further described. The collar 19 may be further comprised of an internal screw thread 80, a protection guard 82, and an outer rim 84. The collar 19 and internal screw thread 80 may cooperatively interact with the external screw thread 27 of the sleeve 10 to movably and removably connect the collar 19 to the sleeve 10. The guard 82 may be connected to the collar 19 as shown in FIGS. 1, 2 and 3 and operably attached in a manner that runs substantially around the entire outer rim 84 of the collar 19. The secondary container 13, collar 19, and guard 82 of the present embodiment may be made of any material known to those reasonably skilled in the art.

The collar 19 may fit so that the collar outer rim 84 would remain substantially coextensive with the surface of the secondary container 13 of one embodiment. The collar 19 would allow the user easier access to the valve assembly 8 through the wall of the secondary container 13. The collar 19 may help to insure that the valve assembly 8 remained in a substantially steady position relative to the secondary container 13 despite movement of the container. The guard 82 of the present embodiment would protect the collar 19 and outer rim 84. In alternative embodiments, the secondary container 13 may have a port that is open and closed so that the collar 19 would remain substantially on the interior of the secondary container 13.

In operation, the assembly of one embodiment present invention is substantially coextensive with the surface of the liner 12 while in its retracted position. Alternative embodiments could be disposed with the assembly coextensive with the secondary container 13 of the IBC, as shown in the accompanying figures. Further embodiments could have the assembly 8 planar with the wall of whatever type of container 13 is employed.

When materials are going to be dispensed, the plug 18 is turned and removed by means of the cooperative interaction of the screw thread 60 on the inside of the plug 18 and the screw thread 40 on the outside of the slide member 14. The slide member 14 itself is then turned utilizing the grip surface 61. With proper movement of the slide member 14, the external member thread form 38 of the slide member 14 and internal thread form 24 of the sleeve 10 cooperatively interact to axially move the slide member 14 from a first retracted position (shown in FIG. 4) to a second extended position (shown in FIG. 3). This second extended position can be any length along the possible slide member 14 path that the user desires. In an alternative embodiment the assembly of the present invention could be utilized with the slide member 14 still in the completely retracted position. The present invention assembly 8 can be used in any position the user desires as long as the operator can engage the valve shaft 66 to open and close the flapper 62.

Once the slide member 14 has reached the selected operating position, the butterfly valve 16 is then utilized. By rotating the valve shaft 66, the flapper 62 is moved about the axis represented by the valve shaft 66. This movement creates a gap between the O-ring 64 of the butterfly valve 16 and the inside surface 36 of the slide member 14. FIGS. 6 and 7 show the open and closed positions of the of the butterfly valve 16 respectively. As can be seen in FIG. 7, the valve surface 62 completely blocks the internal diameter of the slide member 14 when in the closed position. The butterfly valve O-ring 64 creates a seal with the internal surface 36 of the slide member 14. As illustrated in FIG. 6, the O-ring 64 and the valve surface 62 can be moved in a position substantially parallel to the longitudinal axis of the slide member 14 by action of the valve shaft 66 and shaft connector 68. The flapper 62 position allows the material to flow through the gap created between the flapper 62, O-ring 64, and the internal surface 36 of the slide member 14. Material from the container can enter the first opening 44 of the slide member 14, go past the flapper 62, and out the second opening 46. In order to stop the material from flowing out of the slide member 14, the valve shaft 66 may be turned back to the closed position shown in FIG. 7. The valve shaft 66 and flapper 62 may be left in any intermediate position to choose a desired flow rate. The present embodiment valve shaft 66 may be aligned substantially from the top to the bottom of the valve and spout assembly, but as can be appreciated by those skilled in the art, the orientation of the assembly could be changed to any position.

In another embodiment of the present invention, the valve assembly 8 may be placed in a position on the bottom of the secondary container 13 and liner 12. In this alternative embodiment, the valve assembly 8 may drain the material straight down, or in the alternative, the sleeve 10 may be formed of a curved or L-shaped shaft. If the sleeve 10 is an L-shape, then the slide member 14 would be of a length that when it is in the fully retracted position, the first end 30 of the slide member 14 would reach a point short of the bend so that the slide member 14 would not bind inside of the sleeve 10 and become immobile. This box gland formation for the sleeve 10 and slide member 14 of the telescoping valve assembly 8 would still ease storage and transportation difficulties presented by the prior art valve assemblies, but would allow the material to drain substantially from the bottom surface of the container 13, either straight down or through the elbow joint described above.

Figure 8:
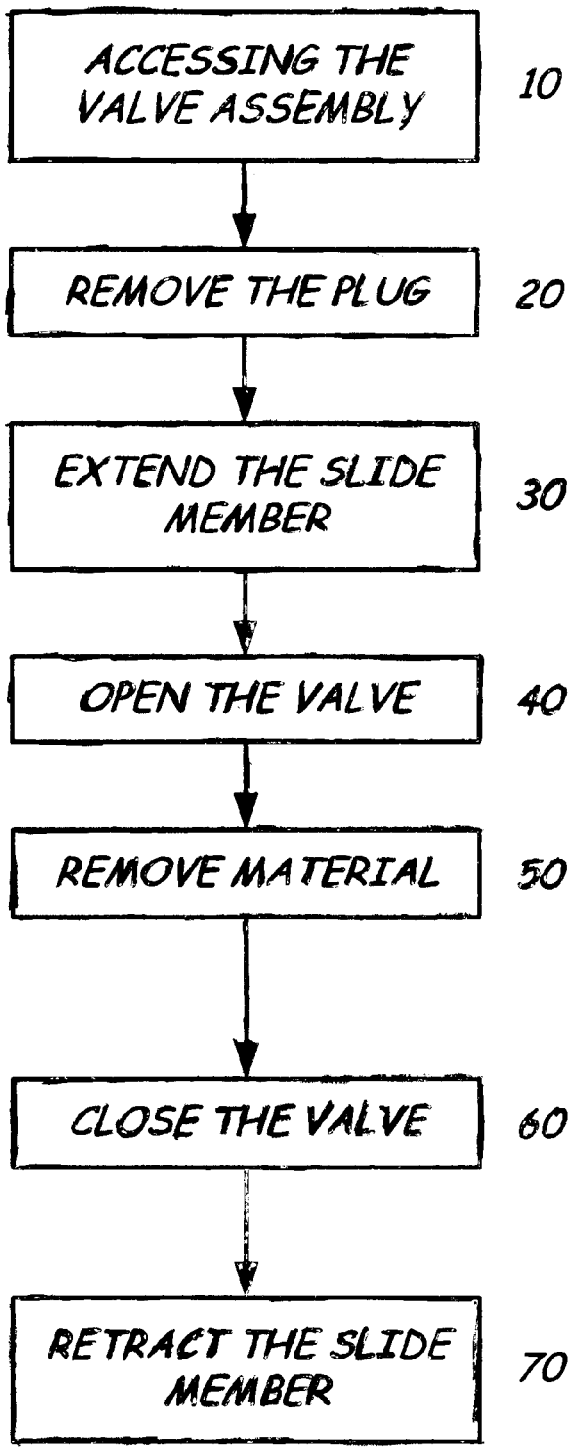
FIG. 8 is a block diagram of the method of operation of using the telescoping valve assembly.

Another embodiment of the present invention telescoping valve assembly 8 comprises a method of removing materials from a container 13 utilizing the above described apparatus. FIG. 8 is a block diagram showing the method of operation. The following description of the method is described in terms of removing material from a IBC container 13 that has an liner 12 to which the valve assembly 8 is attached. This description also contemplates a valve assembly 8 with various parts like the one substantially described previously, including a plug 18, a butterfly valve 16, and the like. However, the below description of this method, though including steps like removing the plug, could have a fewer number of steps depending on the embodiment that is used. Furthermore, this method is equally applicable to the use of the present invention to removal materials from other types of containers to which the present invention may be attached.

As shown in FIG. 8, the first act is gaining access to the valve assembly 8. In the present embodiment this requires that the user remove and/or open the access port of the IBC so that the valve assembly 8 can be accessed. In other embodiments, the valve assembly 8 might be on the outside of the liner 12 and not have a secondary container 13 surrounding the valve assembly 8 and the liner. Once the valve assembly 8 has been accessed, the plug 18 of the present embodiment must be removed. The plug 18 of the present embodiment is removed by rotating the same in a counterclockwise direction. Rotating the plug 18 allows the screw thread form 60 of the plug 18 to operatively interact with the screw thread form 40 of the slide member 14.

Once the plug 18 has been removed, the valve assembly 8 must be extended to the desired operating position. In the present embodiment, the slide member 14 is the part of the valve assembly 8 that is extended. The extension of the slide member 14 is done in substantially the same way as removing the plug 18. The slide member is grasped by the second end 32 grip 61 and twisted in a direction that allows the cooperative interaction of the first screw thread form 38 of the slide member 14 and the internal screw thread from 24 of the sleeve 10. In this way the slide member 14 can be extended to any desired position. In the preferred embodiment, the extension of the slide member 14 past the edge of the substantially ridged secondary container 13 of the IBC would allow the user easier access to the valve assembly 8.

As shown at block 40 of FIG. 8, once the valve assembly 8 is in the desired extended position, the opening of the valve assembly allows the desired material to be removed. The butterfly valve 16 of the present embodiment is opened utilizing the valve shaft 66. Rotating the valve shaft 66 of the present embodiment in either direction allows the seal between the flapper 62, the O-ring 64, and the inner wall 38 of the slide member 14 to be broken. Once the seal between these members is broken, the material begins to flow from the liner 12, through the sleeve 10, through the valve assembly 16, and into whatever receptacle the user so desires. Once the desired amount of material has escaped from the liner 12, the butterfly valve 16 should be rotated utilizing the valve shaft 66 to close the seal between the flapper 62, O-ring 64, and the inside surface 36 of the slide member 14. In alternative embodiments that incorporate a different type of valve 16, the valve 16 must be opened using the proper method that suits the alternative embodiment valve.

As represented by block 50 of FIG. 8, the act of closing the valve assembly 8 ensures that no more material will escape the liner 12 than is desired by the user. The butterfly valve 16 is closed by utilizing the valve shaft 66 to re-seal the connection between the valve assembly 16 and the slide member 14. Once the seal has been re-engaged, the user should rotate the slide member 16 back to the retracted position (Block 70) to again take advantage of the easy transportation and storage capabilities the present invention allows.

One advantage of the present invention is the telescoping nature of the slide member 14 and sleeve 10 screw thread connection. When the spout and valve assembly 8 is not in use, the assembly can be screwed into the retracted position. This retracted position allows the protrusion of the valve assembly 8 to be minimized. Because of the minimization of the protrusion, working with the liner 12 is easier and more convenient. This retracted position reduces the risk that the assembly will be damaged during storage or shipment of the secondary container 13. Furthermore, stacking and storing can be done in a more efficient manner because the combined liner 12, secondary container 13, and valve assembly 8 are a more compact unit.

The telescoping nature of the valve assembly 8 presents yet another advantage to the present invention. Because the valve assembly 8 can be extended to provide a variable distance from the liner 12, this valve and spout assembly can be attached to a liner 12 and used with a container of many different sizes and secondary container 13 wall thicknesses.

Another advantage of the present invention is the convenience of having a valve and spout assembly 8 affixed to the liner 12. Since the assembly is always attached to the liner 12, it assures that whenever the user desires to remove material from the liner 12 there is an attached apparatus for precisely controlling the dispensation of the material. No time is wasted looking for the proper fittings to remove the material.

Another advantage of the present invention is the dispensation control that the valve member gives the user for dispensing the materials. The valve shaft 66 and flapper 62 allows the user to more effectively control the egress of the material from the liner 12 and secondary container 13 then the prior art.

A still further advantage to the present invention is the ability to approximately control the rate of flow of the material using a standard tool. Prior art valve and spout assemblies require the use of specialized tools that were not always readily available to adjust the valve member. The present invention incorporates a valve shaft 66 that can be actuated by a standard Allen wrench, Phillips screwdriver, or the like.

The accompanying Figures and descriptive material depict and describe embodiments of the device of the present invention along with features and components thereof. With regard to fastening, mounting, attaching, or connecting the components of the present invention to form the device or apparatus as a whole, unless specifically described otherwise, the invention may incorporate or use conventional fasteners such as screws, nut and bolt connectors, machined connectors, snap rings, complementary fittings such as snap, threaded or plug/socket arrangements and the like, clamps such as screw clamps and the like, rivets, toggles, pins and the like. Components may also be connected, if appropriate, by adhesives, welding, friction fitting or deformation. Unless specifically disclosed or taught, materials for making components of the present invention are selected from appropriate materials such as metal, metallic alloys, fibers, fabrics, plastics and the like, natural or synthetic, and appropriate manufacturing or production methods may include casting, extruding, weaving, spinning, molding, and machining. It is desirable that any components of the present invention be made of materials that are compatible for use with whatever type of liquids or other materials are going to be handled in conjunction with the valve assembly and container.

Although the description of this apparatus and present embodiment has been specific, it is contemplated that various deviations can be made to this embodiment without deviating from the scope of the present invention. Accordingly, it is intended that the scope of the present invention be dictated by the appended claims rather than by the foregoing description of this embodiment.

What is claimed is:

1. A telescoping valve assembly attached to a container, the assembly comprising:

(a) a sleeve operably connected with the container, the sleeve further comprising an inner surface;

(b) a slide member movably attached to the inner surface of the sleeve wherein the slide member is movably attached to the sleeve by cooperating threads formed on an outer surface of the slide member and on the inner surface of the sleeve and wherein the slide member can be selectively positioned between a retracted position and an extended position; and (c) a valve member operably connected to the slide member wherein the valve member further comprises a butterfly valve; and, (d) a stop adapted to prevent the slide member from disengaging the sleeve.

2. The apparatus of claim 1 wherein the slide member further comprises a seal operably positioned between the slide member and the sleeve.

3. The apparatus of claim 2 wherein the seal between the slide member and the sleeve further comprises an O-ring.

4. The apparatus of claim 3 wherein the sleeve further comprises a slide surface for operable interaction with the seal of the slide member.

5. The apparatus of claim 4 wherein the valve member further comprises a valve shaft operably attached to the slide member and the butterfly valve, wherein the valve member is selectively positionable to control the rate of flow through the slide member.

6. The apparatus of claim 5 wherein the butterfly valve further comprises a sealing member operably connected to the slide member for creating a seal between the butterfly valve and an internal surface of the slide member.

7. The apparatus of claim 6 wherein the butterfly valve further comprises a valve surface operably connected to the valve shaft by a shaft connector.

8. The apparatus of claim 7 wherein the valve shaft further comprises a plurality of sealing members for creating a seal between the valve shaft and the slide member.

9. The apparatus of claim 8 wherein the valve shaft further comprises a tool receiving portion, wherein the formation facilitates the rotation of the valve shaft and the butterfly valve.

10. The apparatus of claim 9 further comprising a plug closure movably attached to the slide member.

11. The apparatus of claim 10 further comprising a plug closure removably attached to the sleeve.

12. The telescoping valve assembly of claim 11, wherein the valve member further comprises a valve shaft, wherein selective positioning of the valve shaft operates to control the position of the butterfly valve and the rate of flow of material through the slide member.

* * * * *